US009200872B1

(12) United States Patent
Millar

(10) Patent No.: US 9,200,872 B1
(45) Date of Patent: Dec. 1, 2015

(54) HARD SOFT BALLISTIC ARMOR

(71) Applicant: David J. Millar, St. Charles, MO (US)

(72) Inventor: David J. Millar, St. Charles, MO (US)

( * ) Notice: Subject to any disclaimer, the term of this patent is extended or adjusted under 35 U.S.C. 154(b) by 154 days.

(21) Appl. No.: 13/967,131

(22) Filed: Aug. 14, 2013

Related U.S. Application Data

(60) Provisional application No. 61/683,050, filed on Aug. 14, 2012.

(51) Int. Cl.
*F41H 1/02* (2006.01)
*F41H 5/08* (2006.01)
*F41H 5/04* (2006.01)

(52) U.S. Cl.
CPC ..... *F41H 1/02* (2013.01); *F41H 5/0478* (2013.01)

(58) Field of Classification Search
CPC ..... F41H 5/08; F41H 5/04; F41H 5/02; F41H 5/0485; F41H 3/02; F41H 7/04; F41H 1/02
USPC ..... 89/36.01, 36.02, 36.05; 2/2.5; 428/911
See application file for complete search history.

(56) References Cited

U.S. PATENT DOCUMENTS 3,867,239 A * 2/1975 Alesi et al. ..... 428/48
5,179,244 A * 1/1993 Zufle ..... 89/36.02
5,362,527 A * 11/1994 Harpell et al. ..... 428/33
5,591,933 A * 1/1997 Li et al. ..... 89/36.02
5,943,694 A * 8/1999 Moureaux et al. ..... 2/2.5
8,534,178 B2 * 9/2013 Howland et al. ..... 89/36.02
8,695,112 B2 * 4/2014 Bhatnagar et al. ..... 2/2.5
2002/0069444 A1 * 6/2002 Graham et al. ..... 2/2.5
2009/0255022 A1 * 10/2009 Smith et al. ..... 2/2.5
2012/0090452 A1 * 4/2012 Sudhakar ..... 89/36.02
2012/0152098 A1 * 6/2012 Howland et al. ..... 89/36.02
2012/0192339 A1 * 8/2012 Bhatnagar et al. ..... 2/463
2012/0196108 A1 * 8/2012 Bhatnagar et al. ..... 428/218
2012/0233733 A1 * 9/2012 Fahnestock et al. ..... 2/2.5
2013/0112071 A1 * 5/2013 Bhatnagar et al. ..... 89/36.02
2014/0272271 A1 * 9/2014 Tam et al. ..... 428/113

* cited by examiner

*Primary Examiner* — Benjamin P Lee
(74) *Attorney, Agent, or Firm* — Charles McCloskey

(57) ABSTRACT

A hard soft ballistic armor has an armor panel with continuous and contiguous hard zones and soft zones providing seamless, gapless fragmentary and ballistic protection to a wearer. The panel comes from a process of pressing UHMWPE panels into hard armor with soft, flexible joints or panels of soft construction into hard panel with a defined shape. The present invention through its processes provides a single or plurality of heated, hard pressed areas and unheated, unpressed areas in the same piece of armor where the soft areas remain flexible. The processes of the present invention apply high and low pressure simultaneously to layers of material resulting in armor panel having a three dimensional shape that fits a portion of the body of a wearer.

6 Claims, 3 Drawing Sheets

HARD SOFT BALLISTIC ARMOR

CROSS-REFERENCE TO RELATED APPLICATION

This non-provisional application claims priority to the provisional application 61/683,050 filed on Aug. 14, 2012 and is a continuation in part of the pending non-provisional application Ser. No. 13/918,420 filed on Jun. 14, 2013 which claims priority to provisional application 61/660,706 filed on Jun. 16, 2012 and is a continuation in part of the pending non-provisional application Ser. No. 13/907,434 filed on May 31, 2013 which claims priority to provisional application 61/654,853 filed on Jun. 2, 2012 and which is a continuation in part of the pending non-provisional application Ser. No. 13/523,972 filed on Jun. 15, 2012 which claims priority to provisional application 61/498,300 filed on Jun. 17, 2011, all of which are owned by the same inventor.

BACKGROUND OF THE INVENTION

The hard soft ballistic armor relates generally to reduction and prevention of injuries inflicted upon persons, such as ground personnel, from improvised explosive device, or "IED," and anti-personnel mine blast events. The hard soft ballistic armor more specifically relates to the shaping of armor panels over partially round parts of a person's body. A person, military or civilian, can readily wear the invention as it fits upon chest, elbow, ankle, and the like.

Before the Battle of Poitiers, 1356 AD, the military and its feudal lords developed plate armor. Armorers became skilled metalsmiths as they fashioned plates of iron into steel. Armorers built fires to high temperature and produced many coals. With the coals still warm, the armorers would bury the plates of iron with the coals in chambers in the ground. The armorers then returned to the chambers after a time and unearthed the plates. This application of carbon through coals into the plates of iron formed the plates into steel. The armorers then assembled the plates of various shapes upon leather straps into a suit of armor. The suit of armor had plates adapted to the contours of each knight or other wearer of armor. Suits of armor became as custom fit as tailored clothes. Knights, and other armor wearers, had to move their limbs so the suits were fitted with joints and various sliding plates. The joints though provided a point of weakness, a chink if you will in the armor. As noted by members of a band of yeomen, even a child can be taught to find those chinks and send an arrow to them.

Not to long after the Battle of Poiters, gunpowder arrived on European battlefields, thus hastening the demise of armored knights and metal armor in general. However, personal armor has staged a comeback in recent years but in different form.

From before the Revolutionary War, the military developed mines and used explosives. Mines began as containers of gunpowder concealed upon a battlefield and triggered by release of various mechanical actuators like trip wires. Military explosives started as full gunpowder containers triggered with fuses or rifle rounds. From those beginnings in this country mines and military explosives have evolved, proliferated, and developed in other countries. Present day mines serve two purposes: anti-tank and anti-personnel, abbreviated as AT mines and AP mines respectively. AT mines may include warheads so that the AT mine can disable an armored vehicle. AP mines generally have less explosive than AT mines. AP mines generally remain small in size, readily carried, quickly concealed, and designed to maim the limbs of a soldier. Such limbs include the chest, the arms, and the leg with its femur bone in the upper leg and the fibula and tibia bones in the lower leg. AP mines come in various shapes and sizes ranging from toe-poppers up to leg severing devices. Along with mines, the fire from small arms remains prevalent upon modern battlefields.

In the last decade, military action in Iraq and Afghanistan has seen the rise of improvised explosive devices, or IED by the enemy. These devices generally have a home made construction of explosives and placement in atypical locations such as in walls three feet above the ground, in peasant carts, on persons, in cargo, and the like. IED have posed an asymmetric threat to US and allied forces and civilians in the Iraqi and Afghani theatres of operations.

To mitigate the IED threat, military forces have increased their force protection efforts. These efforts have placed more personal armor upon ground personnel, or soldiers, even for routine tasks, such as mail delivery, than in prior military conflicts. The armor includes various vests such as flak vest and bulletproof vest, leggings, shin guards, and chest plates to name a view. Widening of deployment for the Explosive Ordnance Disposal, or EOD, blast suit has also occurred to additional personnel. The efforts have also adjusted tactics and procedures for movement of combat and non-combat soldiers across terrain, in rural areas, and in urban areas. However, the enemy has recognized this and adapted the IED to more potent models and placement at chest height in uncommon locations such as partly up a wall from a walking surface. The US has also responded with greater usage of EOD blast suits and flak vests. The blast suits and flak vests generally include flat panels of armor within a Kevlar outer layer. The panels have their dimensions and thus joints appear between panels.

Though this application mentions military and soldier, the Applicant utilizes those terms in a broad sense to represent all military services, their personnel, and to include select heavy civilian applications such as mining and quarrying that involve blasting.

DESCRIPTION OF THE PRIOR ART

Traditionally, manufacturers have provided armor to military specifications. The armor stops fragments from explosives, such as mines, and select ballistic armor stops bullets from small arms and light machine guns. Presently, ballistic armor includes hard panels, soft panels, or both. The panels have a construction of multiple layers of ultra-high molecular weight polyethylene, or "UHMWPE," fabric which is also called para-aramid. The UHMWPE accumulates in layers to provide the desired level of ballistic protection. However, each panel has its dimensions and generally retains a planar form. Because wearers of personal armor must move their limbs, the panels allow for motion between adjacent panels through joints or gaps. The gaps though present a location for a fragment or bullet to penetrate between two panels and injure or kill the wearer.

The present invention reduces and in some events prevents injuries to the chest, torso, abdomen, leg, arm, foot, ankle, hand, wrist, fibula, tibia, radius and ulna of soldiers wearing the invention and who encounter anti-personnel mines placed in expected or unexpected locations or small arms fire.

SUMMARY OF THE INVENTION

Generally, the present invention provides a process of pressing UHMWPE panels into hard armor with soft, flexible joints or UHMWPE panels of soft construction into hard panel with a defined shape. The process of the invention provides the benefits of hard armor panels while retaining a seamless, gap less protection of soft ballistic armor. The present invention through its processes provides a single or plurality of heated, hard pressed areas and unheated, unpressed areas in the same piece of armor where the soft areas remain flexible.

The present invention allows for cutting or molding of its hard and soft panels in various sizes, widths, lengths, and thicknesses that fit intended applications, provide the specified ballistic protection level, and allow for single piece construction or multiple section construction. The panels of the invention may also undergo heat and pressure molding in one portion to provide the specified hard panel protection while the remainder of a panel provides the desired soft flexible ballistic protection. The panels usage of hard and soft portions allows the soft portion of panel to be sewn into a garment or covering or allow the panel to have attachment or hold down points sewn upon them without sacrificing the integrity of the hard portions of the panel. Larger panels of armor made as the invention permit introduction of living hinges for access behind a panel and the soft portions of the armor panels fold for storage in a smaller space than other vests and panels.

This invention builds upon a blast deflecting sole shape, a layer to reduce and stop high velocity fragments, a padded surface that limits the blast forces transmitted to the tibia, fibula, ankle, and foot during blast events, and an upper of high velocity blast fragment reducing fabric. Previously a boot blended layers of hard and soft ballistic material into a sole with an integral flex section. The boot had the sole within a layer of non-slip urethane that contains energy absorbing foam, a layer of high velocity fragment reducing fabric para-aramid or ultra-high molecular weight polyethylene, or "UHMWPE," fabric, and a core of closed cell single or multiple density high energy absorbing foam that absorbs impact forces. The sole includes a V shape with a centered keel and a plurality of cleats containing energy absorbing material for disposition on the bottom of the boot. The sole generally has para-aramid reinforced urethane or alternatively UHMWPE, fabric. The insole has a high velocity fragment reducing layer system of multiple layers of UHMWPE or para-aramid. The energy absorbing layers and cleats utilize single or dual density closed cell energy absorbing foam, such as expanded polypropylene, or "EPP," expanded polyethylene, or "EPE," or foamed silicone. The sole has an exterior coating or layer of anti fungal, non slip, polyurethane. The sole also may be cut, molded, extruded, and the like, in various sizes. The sole of the present invention may have a unitary form or be assembled from multiple sections. The upper also protects the ankle, tibia, and fibula using, UHMWPE, para-aramid, ballistic nylon, or additional thickness of leather. The upper has typical closures from laces, zippers, hook and loop fasteners and the like.

This invention reduces the injuries suffered by soldiers as it provides an armor panel shaped to fit curved portions of a soldier's body, one or more layers to reduce and stop high velocity fragments. Women specifically benefit from this invention however, any soldier may wear the armor panel of this invention if need be.

The Applicant has considered expanded polyethylene, or EPE, and expanded polypropylene, or EPP, as suitable materials to attenuate impact and withstand the elements and biological decay. During testing, the EPP exhibited difficulties with cost and lack of ability to support adhesion upon its surface. The Applicant has solved the lack of adhesion through this invention. The Applicant has removed the low coefficient of friction skin formed upon the surface of an EPP object during its manufacture. The manufacturing of a sole molds and expands polypropylene beads, or pellets, into a piece. However the surface of the piece develops a skin with a smooth exterior because the beads melt and acquire the surface characteristics of the mold, generally smooth. The present invention has skived the surface of a sole and thus exposed approximately 50% of the crystalline structure of individual cells of polypropylene in the piece. Skiving shaves, or imparts, cuts to the surface of the piece making that exposure of the cells. With this cell exposure, the Applicant found a coating that replaces the skin of a wedge, or core, yet allows for other items to adhere, or bond to, the coating applied upon a wedge or core.

There has thus been outlined, rather broadly, the more important features of the invention in order that the detailed description thereof that follows may be better understood and that the present contribution to the art may be better appreciated. The present invention also includes a usage of a vacuum to draw material into the desired shape of the armor panel, simultaneous application of high and low pressures to material, similar heating of hard and soft zones of an armor panel, bonding between layers of material, and continuity between adjacent hard and soft zones so that no gaps form between them. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved hard soft ballistic armor that reduces the gaps and joints in a panel of armor thus lessening the risk of injury to a soldier.

Another object of the present invention is to provide a hard soft ballistic armor that decreases impact forces upon a soldier's foot from a blast or a ballistic event.

Another object of the present invention is to provide a hard soft ballistic armor that has hard and soft portions in the same panel, providing flexibility in the panel.

Another object of the present invention is to provide a hard soft ballistic armor that limits the forces transmitted to the soldier's body beneath the armor.

Another object is to provide such a hard soft ballistic armor that can be easily and readily worn by civilians with little to no skill, military personnel of all ranks, and foreign nationals with little if any comprehension of English.

Another object is to provide such a hard soft ballistic armor that resists degradation from fire, water, chlorine, ultraviolet light, bacteria, microbes, fungi, and saltwater.

Another object is to provide such a hard soft ballistic armor that adjusts to the contours of the wearer.

Another object is to provide such a hard soft ballistic armor that can be easily and efficiently manufactured and marketed to government departments and agencies and select civilian applications.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
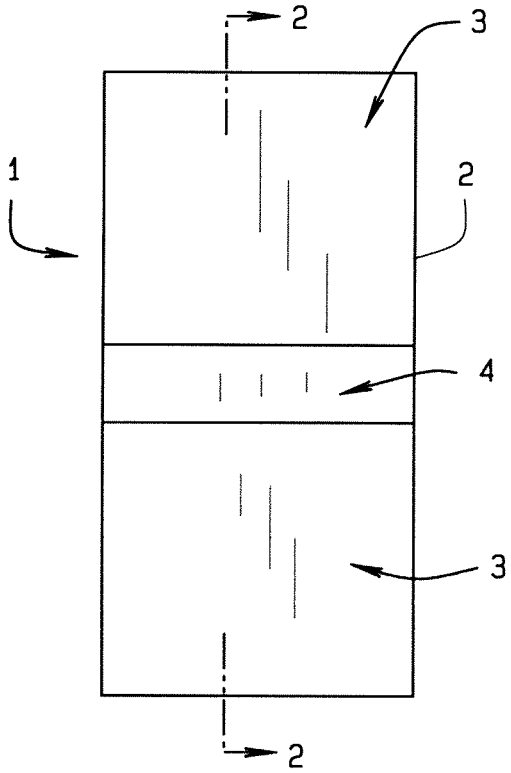
FIG. 1 shows a front view of a panel of the invention.

The present invention overcomes the prior art limitations by providing hard soft ballistic armor that permits flexibility and three dimensional portions at the desired level of ballistic protection. The invention will be better understood from a reading of the following detailed description of the preferred embodiment and alternate embodiments of the invention in conjunction with the figures in which the sizes and distances between various elements does not represent actual sizes or distances between various elements.

The panels of the invention see use in hard or soft ballistic armor applications. The panels of the invention may also see use in any area for ballistic impact energy manager. The panels utilize key UHMPWE properties including aerial density, number of layers, pressed areas, unpressed areas, among others, selected for tailoring towards the special applications involved with ballistic armor.

The panels of this invention build upon the technology of those co-pending applications claimed in the cross reference section. For instance, a blast mitigating boot has its upper closed by laces upon a sole that has a V shape, through its thickness and cleats spaced upon the sole. The cleats provide traction in combination with the sole. The V shaped sole utilizes a wedge shaped energy absorbing system, or pad system, for use in boot soles that reduces or prevents lower leg injuries from mines and other explosives. The wedge shaped pad system applies to various boots as used throughout the military and heavy industries. The pad system, or core, reduces the blast forces, often accelerations of sole material, which transmit forces resulting injuries into the foot, ankle, tibia, and fibula of a soldier. This boot incorporates readily into military specification boots and allows for ready cleaning of the soles in both garrison and field environments. The invention may see use in military and civilian applications the require impact energy management.

The V shape relies heavily upon the cleats, often a plurality of them, to provide traction for the boot. The V shape generally has its vertex slightly above the plane defined by the terminations of the cleats. The vertex is generally opposite the upper and particularly the high velocity fragment reducing layer. This spacing slightly above the cleats lessens wear of the V shape so that blast resistance meets specification through the useful life of the boot.

The sole's V shape has a key property of blast to sole angle, that is, the angle between one half of the V shape and a horizontal plane such as a walking surface or the high velocity fragment reducing layer, of about 20° to about 60° as at $\phi$ and with a preference of 45°. The invention also has key properties in its cell structure, recovery rates and stiffness, and coating components and processes suitable to blast mitigation.

The sole has its length, a generally V like shape to deflect blast forces and has a plurality of cleats in a pattern common to boot soles. The sole has its keel that extends for the length of the sole and denotes the vertex of the V like shape, or internal angle. The keel cooperates with the cleats for traction but has a spacing slightly above the cleats to maximize useful life. The sole has a generally urethane construction reinforced with para-aramid and has these key blast force reduction properties: compressive strength from about 2300 psi to about 8000 psi, flexural strength from about 1500 psi to about 5200 psi, flexural modulus of about 100,000 psi to about 950,000 psi, tensile strength of about 1500 psi to about 8000 psi, tensile modulus of about 70,000 psi to about 950,000 psi, and shore A hardness of about 50 to about 90. The assembly of the sole includes para-aramaid or UHMWPE materials woven together, in a unidirectional manner or in a non directional manner, same or different weights and thicknesses. The sole has vertical layering and a foam density of about 20 g/I to about 200 g/I. This invention also has cell structure, recovery rates, stiffness, and manufacturing technology suited to it.

Another embodiment of the sole the V shape with cleats but has a flexure zone proximate the intended location of the ball of the foot of the soldier when wearing the boot. This embodiment has an interruption in the keel and in the core which do not span over the flexure zone. The sole merges hard and soft ballistic material so that flexure of the sole occurs in the zone without a portion of the keel and the flexure zone remains integral with the remainder of the sole. The flexure zone has sufficient length, along the direction of the keel, to permit the desired flexing of the sole, as when a soldier is running, while maintaining the greatest extent of blast resistance. The flexure zone has the cushioning layer and the high velocity fragment reducing laminated layer but not the keel and core so that the sole may bend at the flexure layer. Typically, the flexure zone has a length less than that of two cleats.

Turning more closely to the construction of the sole, the boot sole has an energy absorbing foam layer or cushioning layer incorporated into the sole and opposite the vertex, a high velocity fragment reducing laminated layer beneath the cushioning layer, a blast deflecting V shape or wedge like sole and another energy absorbing layer or core. The layer is generally planar and extends for the length and width of the sole. The layer has construction of high velocity fragment reducing material such as UHMWPE or para-aramaid materials. The UHMWPE may have soft or hard formulations. Together the cushioning layer and the high velocity fragment reducing laminated layer operate as an insole. Beneath the fragment reducing layer, that is, away from the soldier's foot, the core has a cell structure of single density foam or alternatively dual density foam depending upon the specific application, particularly impact attenuation, preferably EPP or alternatively EPE. The foam in the sole's core has a density in the range of about 20 g/I to about 200 g/I, and specific cell structure, recovery rate, and stiffness that dissipate the energy of an impact upon the V like shape. The core may also utilize silicone gel packs in an alternate embodiment. Generally the core is positioned within the V shaped cross section of the sole, that is, interiorly of the sole. The V shape of the sole, and the exterior of the foam and fragment reducing layer include a coating.

The core, generally of foam, has the construction of EPP with select properties. The Applicant has tested various formulations of EPP in pursuit of a proper strain rate and density for blast and impact resistance. Devices that seek to attenuate blast and impact forces undergo testing according to certain military testing, not described here. Such testing has similarities to ASTM F1292, Standard Specification for Impact Attenuation of Surfacing Materials within the Use Zone of Playground Equipment. This Standard determines whether a material attenuates impact forces. A material that meets the Standard has these properties: a Gmax less than 200, a HIC less than 1000, densities from about 1.9 to about 3.7 pcf, strain rates between about 0.1 to about 0.4 MPa. At these densities, the EPP material works well for applications in temperatures from about −22° F. to about 212° F. as blast mitigating material. For applications at colder temperatures, EPE has a density between about 2.3 to about 4.2 pcf, strain rates between about 0.1 to about 0.4 MPa, and an operating temperature range of about −76° F. to about 160° F. The coating, preferably a select polyurethane, increased the operating temperature range an additional 20° F. to about 180° F. The EPP of the boot's core also meets military specifications.

Though a core of closed cell foam is shown and described above, the Applicant also foresees a hollow core with corresponding increase in thickness to the V shaped of the sole. The hollow core also maintains the blast to sole angle of about 20° to about 60° as at $\phi$ and with a preference of 45°.

The boot has its ballistic upper attached to the sole 101 and closed by laces. The upper is preferably leather lined with soft UHMWPE. Alternatively, the upper may be of ballistic fabric, UHWMPE, or thicker leather. The upper joins to the sole with the cleats opposite the upper. The sole has an elongated shape that fits beneath the upper and has a typical footprint like shape. Opposite the upper, the sole has a plurality of cleats depending therefrom. The cleats have a spacing and arrangement suitable for traction on a variety of terrain. Inwardly from the cleats, the sole has its V like shape extending for the length of the sole except through a flexure zone here shown forward of the soldier's heel. The flexure zone generally lacks a portion of the keel that extends beneath the heel and forefoot of a soldier. Wearing the boot, the soldier has reduced leg motion, reduced energy transmission, and reduced injuries to the foot, ankle, fibula and tibia. The boot's sole's V like shape places a portion of the sole at an angle to the walking surface of the soldier of about 20° to about 60° as previously shown at $\phi$, preferably 45°. With this angle of the sole, any blast energy radiates away from the soldier's foot.

From the side, lengthwise, the sole appears as a rectangle. From the soldier's foot outwardly, the sole begins with the layer of energy absorbing foam here shown towards the top of the figures, that is, above the cleats and opposite the vertex. Below the foam layer, the sole has the high velocity fragment reducing layer or insole. The foam layer and the insole extend for the length of the boot. Beneath the fragment reducing layer, the sole has its core shown as a rectangle because of the lengthwise section. The core is typically closed cell foam. An alternate form of the core utilizes silicone gel packs, to fill the core. Beneath the core, the sole has a section of the V like shape, here though shown as a rectangle. Depending on the location of the section through the sole, the apparent thickness of the core expands and contracts and the section of the V like shape lowers and rises in the drawing. The layers, the V like shaped sole, and the core, each have a perimeter defined as the outermost portion and located proximate the outer portions of the bottom of the upper when the boot is assembled.

Beneath the section of V like shape, the sole has a urethane coating or outsole. The urethane coating includes the cleats, covers the V like shape of the sole, and then extends upwardly upon the perimeter of the core and the layers. From the exterior of the boot, a soldier would see the urethane coating. In an alternate embodiment, the coating extends over the cushioning layer and completely encases the sole. The coating elongates proportionally to the core and the sole.

The boot sole assembles the foam layer upon the fragment reducing layer which covers the core within the V shaped sole and places the assembled layers, core, and sole in a mold filled with the composition of the coating. The next step of manufacturing applies heat and pressure to the mold and the assembled layers, core, and sole with coating in the mold. The Applicant utilizes a mold temperature from about 185° F. to about 225° F. and pressurization of the mold from about 1850 psi to about 4300 psi to form the boot, particularly its sole. The temperature and pressure of the mold transfer to the assembled layers, core, and sole, and the coating resulting in unitary sole that includes the V shape merged with the core and layers. In an alternate embodiment, the energy absorbing layer is merged to the high velocity fragment reducing layer to form a unitary insole utilizes a mold temperature from about 185° F. to about 225° F. and pressurization of the mold from about 1850 psi to about 4300 psi during a compression molding process.

The coating includes from about six to about nine components that allow a mechanical bond of the coating to the substrate of the V like sole and the perimeters of the core and the layers following skiving. The coating has the following properties: less than 3% shrinkage, tensile strength in excess of 2000 psi, an elongation of 300%, a high coefficient of friction from about 0.7 to about 1.3, a shore hardness in excess of 75A, an operating temperature range of about −40° F. to about 210° F., and a lack of support for biological activity. The coating has a burn rating of 0.0" following FAA testing of approximately 1600° F. for approximately 15 seconds. The coating prevents warping of the sole and its elongation allows the coating and the substrate to attenuate impact forces during usage. The coating also permits inclusion of other components such as tinting agents, matting agents, traction additives, such as sand, vinyl flatteners, and fibers for cut resistance, particularly para-aramid synthetic fiber, such as polyparaphenylene terephthalamide or Kevlar®, and additives that impart resistance to ultraviolet light. The traction additive, or agent, imparts to the coating a coefficient of friction from about 0.7 to about 1.30 that reduces or lessens impact injuries by reducing the probability of slips and falls when using the boot. These other additives impart durability and slip resistance to a piece for various applications.

Preferably, the coating includes Scorpion X02-ZBG Biocidal Polyurethane made by Custom Concept Coatings of Belleville, Ontario, Canada. This polyurethane coating has three components: part A, part B, and part C. Part A has 1,1'-methylenebis(4-isocyanatocyclohexane), or $C_{15}H_{22}N_2O_2$, from Tokyo Chemical Industrial, Ltd. of Japan, and 2-n-Octyl-4-isothianzolin-3-one, or $C_{11}H_{19}NOS$, from Dalian Haoyuan Jinghua Science & Tech. Development Co., Ltd. of Yantai, China. Part B has proprietary miscellaneous zinc compounds and n-butyl acetate, or $C_6H_{12}O_2$, from Celanese Corp. of Oberhausen, Hoechst, Germany. Part C provides a catalyst containing at least one acrylic polymer, at least one residual monomer, and water. The preferred embodiment has these components mixed in ratios suitable to achieve the intended goals. The mixture has generally about 2 to about 3 parts A, about 0.5 to about 1.5 parts B, about 0.5 to about 1.5 parts C. For coloration and traction, the mixture includes about ⅛ to about ⅙ parts tint and about 1 part traction additive. The preferred embodiment of the coating for the boot sole has the exact proportions of 2.5 parts A, 1 part B, 1 part C, ⅐ parts tint, and 1 part traction additive. Preferably, the formulation of the coating these steps: blending part B into to part A, then adding part C to the blend of part B and part A, and then adding various additives as desired into the blend of part C into part B and part A. The preceding general and precise, preferred and alternate, mixtures undergo mechanical mixing for about 1.5 minutes to about 3.5 minutes, preferably 3 minutes. The mixing preferably occurs from about 55° F. to about 100° F. at a relative humidity of 5 percentage points less than the air temperature. The mixtures may be applied as a coating upon the EPP core using a high volume, low pressure, or HVLP, spray gun, brush, roller, or trowel within 20 minutes.

As desired by the end user, the coating attains a gloss finish without any flattener, a semi-gloss finish with 0.5 parts flattener, and a matte finish with 1 part flattener. For enhanced durability, the mixture of the urethane includes 1 part Kevlar fibers. Alternatively, construction of the sole laminate Kevlar fabric upon the surface of the EPP core and integral with the coating.

The preceding description and figures often referred to a soldier. The references to a soldier and his role serve as examples because the invention installs can be worn by other persons. Such persons include without limitation Marines, sailors, airmen, coast guardsmen, miners, quarrymen, government workers dispatched to a hazardous area or a combat zone, deminers, and like persons and in roles that may encounter mines in known or unknown locations.

The boots may be cut, sewn, and molded in various sizes to fit the intended application. The boots also have single piece construction or is assembled in multiple sections. The layers and foam referenced for the boots includes adjusting their thicknesses and angles to provide the proper level of protection in higher risk areas, that is, areas of a foot more exposed to blast effects, primarily the sole.

Figure 2:
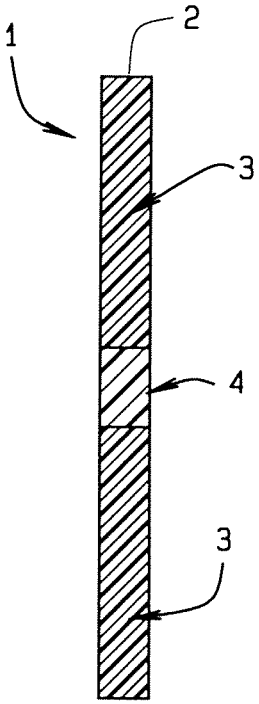
FIG. 2 provides a side view of the panel.

While soldiers wear boots to protect their feet, modern combat and the presence of IEDs, call for soldiers to wear armor on other portions of their bodies. Much like the knights of old, modern armor has to fit the bodies of the soldiers and allow them to move their limbs. FIG. 1 shows a panel of armor of the invention 1. The panel has a prototypical rectangular shape for illustrative purposes thought the panel may have other shapes to fit curved portions of the soldier's body contiguously, that is, without gaps or joints, for example upon elbows, breasts, buttocks, and knees. The invention has a panel 2 with two spaced apart hard zones 3 and a soft zone 4 contiguous and continuous between the hard zones. The hard zones and the soft zone each resist ballistic action while the hard zone has a greater degree of ballistic resistance. The soft zone with its lesser degree of ballistic resistance provides flexibility between the two hard zones. FIG. 2 shows a sectional view through the panel. The soft zone has the same thickness as the hard zones. The soft zone also has a continuous and contiguous merge into the hard zones. This merge maintains ballistic protection and eliminates a gap between the zones because such a gap may allow passage of ballistic fragments.

Figure 3:
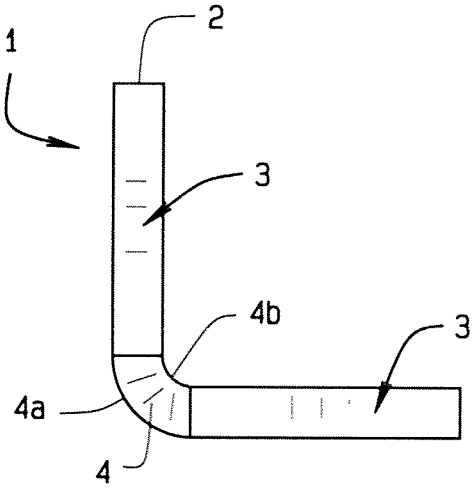
FIG. 3 illustrates a side view of the panel when bent.

FIG. 3 illustrates the soft zone 4 in action. The panel has its two hard zones 3 bent upon the soft zone so that the two hard zones have a generally perpendicular orientation as shown. The soft zone gently deforms while maintaining its continuous and contiguous merge with the hard zones. The soft zone compresses upon the interior of the bend, as at 4*b*, and elongates upon the exterior of the bend, as at 4*a*. The soft zone has it thickness vary through the bend as shown while the hard zones maintain their thickness as at 6. This ability to bend the soft zone and adjust the position of the hard zones serves as the foundation for armor panels having three dimensional shapes in whole or in part.

Figure 4:
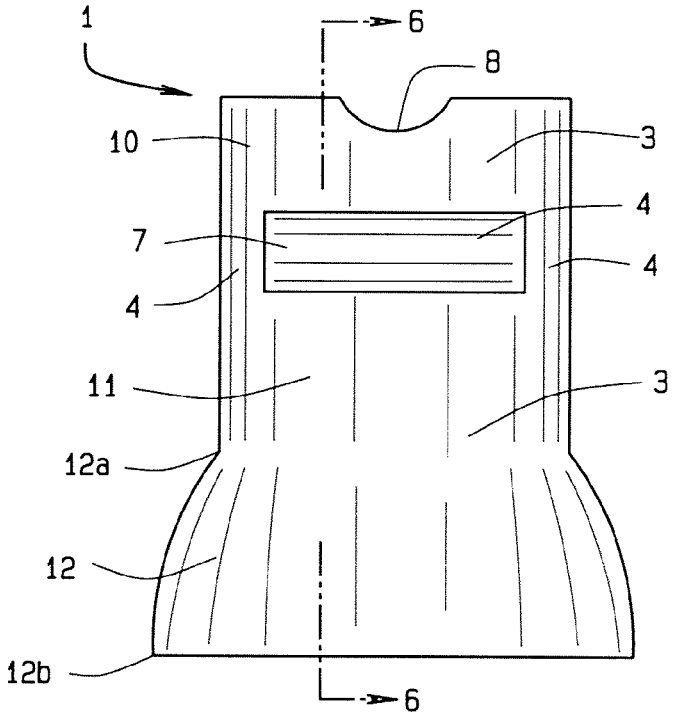
FIG. 4 describes a front view of the panel with a chest pocket.

FIG. 4 provides a drawing of an armor panel incorporating the hard and zones with a portion of the panel in three dimensions, that is, extending outwardly from the remainder of the panel, into the foreground of the figure. This armor panel generally functions as a vest. This vest has two hard zones 3 separated by a soft zone 4. The hard zones occupy the majority of the vest while the soft zone has a lesser portion of the vest. As shown in the figure, above the soft zone, the hard zone 3 has a neck opening 8 into a chest zone 10. The vest extends over the shoulders of a soldier, partially around the soldier's neck, and then down to the chest. The soft zone extends outwardly from the remainder of the vest into a pocket 7. The pocket has a generally elongated, rounded shape outwardly from the plane of the armor panel, that is, away from the body of the soldier wearing the armor panel. The pocket provides a comfortable fit to women soldiers, who wear this vest as their breast structure fits readily into the pocket. The pocket has its two ends, that is, the outer most portions closed. In an alternate embodiment, the pocket has its two ends generally open so that a soldier may insert her hands or other items into the pocket for ballistic protection. Beneath the pocket, the vest has an abdomen zone 11 generally of similar width to the chest zone 10. Then beneath the abdomen zone, the vest has a skirt 12 that flares outwardly in width. The skirt has the greatest width of the vest so that the vest can fit upon the military utility belts and equipment generally worn about the hips of a soldier. The skirt merges with the abdomen zone at a waist 12*a* and the skirt denotes the bottom of the vest, that is, opposite the neck opening 8, along its lower edge 12*b*.

Figure 5:
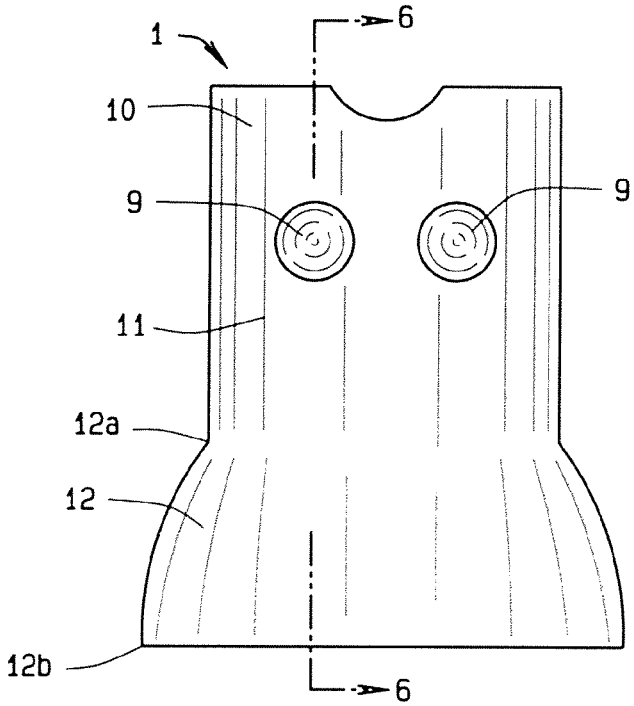
FIG. 5 shows a front view of an alternate embodiment of the panel suitable for a female.

FIG. 5 provides an alternate embodiment of the vest where the soft zone has the form of two spaced apart cups 9. The cups each have a generally round, or partially spherical, shape and both extend in the same direction outwardly from the plane of the armor panel. The cups provide a comfortable fit to women, or females, who wear this vest close to their chest, such as beneath a military field coat or upon a t-shirt. The cups allow each breast its own rounded protection from a soft zone formed into a desirable shape. Unlike the elongated pocket 7 of FIG. 4, the cups 9 of FIG. 5 have a mutual spacing and separation between them. The spacing allows for the presence of a portion of a hard zone 3 between the chest zone 10 and the abdomen 11. This hard zone between the cups provides ballistic protection to the sternum and tissue behind it of the soldier.

Figure 6:
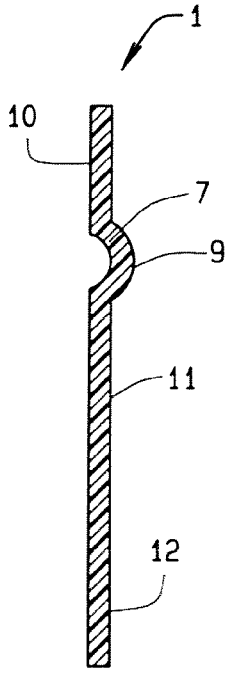
FIG. 6 provides a sectional view through the panel.

The pocket 7 or the cup 9 does extend outwardly in relief for the remainder of the vest or the armor panel as in FIG. 6. The vest has its chest zone 10 above the abdomen zone 11, upon the skirt 12. The chest, abdomen, and skirt are generally coplanar while the pocket 7 or the cup 9 extends outwardly from that plane. The pocket or the cup has a generally rounded cross section, leaving a hollow portion upon the interior of the vest, that is, the side that abuts the body of the soldier.

Having described one piece of armor panel 2, this invention allows for marking various pieces besides a vest. Armor panel fitted to a person may have to account for curvatures of body portions and the articulation at joints. The vest described has a commonality with other armor panels in its construction. The present invention has a process of construction shown in a diagram in FIG. 7. An armor panel begins by assembling layers of material, such as UHWMPE, into a stack as at 100. The layers range in number from three to about one hundred sixty. Three layers are later shown in FIG. 8 however more than three layers are foreseen. The layers and the ultimate resistance or proof against fragments and bullets remain subject to International Traffic in Arms Regulations of the U.S. State Dept., 22 C.F.R. §120 et seq. Those regulations change from time to time which may call for adjusting the number of layers. To assemble the layers into a stack for later bonding, the invention utilizes an adhesive of urethane, rubber, and the like between adjacent layers.

The layers are then placed as at 105 into a mold. The mold generally has the size and contours of the desired armor panel. The mold is preferably shaped to the curvature for the finished armor panel. Alternatively, the mold has a generally flat form. The layers are then deformed as at 110 into the mold. The deformation occurs using vacuum applied beneath the layers and the mold so that the layers deflect into the mold's contours. Then heat is evenly applied as at 115 to the entire mold having the layers within it. The mold attains a temperature from about 185° F. to about 225° F. With the mold and layers heated, the process supplies a higher pressure to portions of the mold as at 120 to form the hard zones of the armor panel and a lower pressure to portions of the mold as at 125 to form the soft zones of the armor panel. The higher and lower pressures are applied simultaneously and simultaneously with the heat so that layers of material deform into the mold contours without any gaps. Both pressures are in the range from 0 psi to about 4300 psi. The higher and lower pressures along with the heat have application for a time interval as at 130, where the time interval is the range of about ten minutes to about forty minutes. After passage of that interval the mold is opened as at 135 and the armor panel removed. The armor panel then has a cure as at 140. In the absence of vacuum application as by the invention, the cure time extends to thirty days. In using vacuum during the invention, the cure time decreases to less than one day. Upon completion of the cure, the armor panel has the achieved operation readiness.

Figure 7:
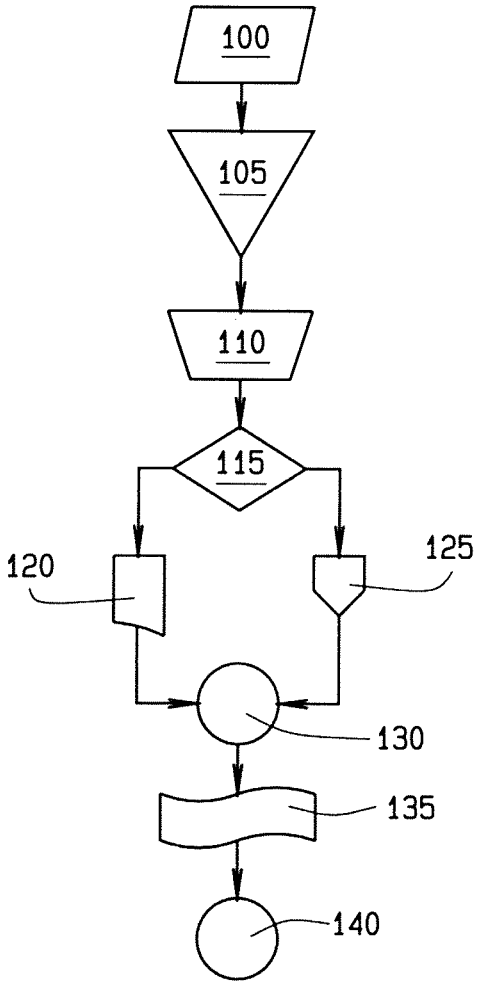
FIG. 7 illustrates a flow chart of the method of the invention.
Figure 8:
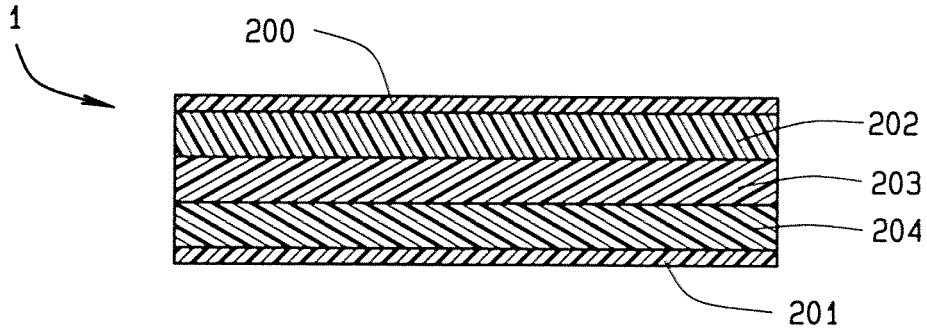
FIG. 8 describes a detailed view of the layers of the invention.

The armor panel shown in FIGS. 1-6 and constructed by the process of FIG. 7 yields a panel of various layers as shown in FIG. 8. FIG. 8 shows a cross section through an armor panel of this invention 1. The armor panel has an outer surface 200 visible on the front of a soldier wearing the panel properly. The outer surface includes a camouflage pattern suitable to the combat environment such as desert, urban, woodland, or snow. Beneath the outer surface, the panel has a first layer 202 of material, such as UHWMPE. Beneath the first layer is a second layer 203 of materials, usually UHMWPE. The second layer bonds to the first layer for a continuous connection between them. And in this embodiment, a third layer 204 of material, such as UHMWPE is beneath the second layer. The third layer also has a continuous bond to the second layer so that the three layers operate as a unit and provide the desired level of ballistic protection. This invention also foresees additional layers proportional in number to the desired level of ballistic protection and also cognizant of the weight of the armor panel. Opposite the outer surface and inwardly of the third layer, the armor panel has an inner surface 201 not visible on the front of a soldier wearing the panel properly. The inner surface generally abuts the military field coat of the soldier, the soldier's undergarments, or perhaps directly upon the soldier's skin.

From the aforementioned description, hard soft ballistic armor has been described. The hard soft ballistic armor is uniquely capable of deflecting blast and impact forces away from a portion of soldier's body while fitting to the curvature and articulation of the portion. The hard soft ballistic armor and its various components may be manufactured from many materials, including but not limited to, EPP, EPE, polymers, polyvinyl chloride, high density polyethylene, polypropylene, closed cell foam, open cell foam, nylon, leather, select metals, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. The invention has been described in terms of an illustrative embodiment. As those skilled in the art will appreciate, various changes and modifications may be made to the embodiments as shown without departing from the spirit or scope of the invention. It is not intended that the invention be limited by the specific embodiment shown. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A process of making an armor panel fitted to a curved portion of a person's body comprising the steps of:

assembling a plurality of layers of high velocity fragment reducing material;

placing said plurality of layers upon a mold;

deforming said plurality of layers into the mold under vacuum;

heating the mold and the plurality of layers;

applying a first pressure to a portion of said plurality of layers;

applying a second pressure to another portion of said plurality of layers;

simultaneously keeping the first pressure, the second pressure, and the temperature applied for a time to said plurality of layers and the mold;

removing said plurality of layers from the mold; and, curing said plurality of layers into an armor panel.

2. The armor panel making process of claim 1 further comprising:

said high velocity fragment reducing material including one of ultra high molecular weight polyethylene and para-aramid; and, said plurality of layers including one of urethane or rubber as an adhesive between adjacent layers.

3. The armor panel making process of claim 2 further comprising:

said heating the mold and the plurality of layers occurring in a temperature range of about 185° F. to about 225° F.;

said applying a first pressure occurring in a range from about 0 psi to about 4300 psi;

said applying a second pressure occurring in a range from about 0 psi to about 4300 psi; and, said keeping the first pressure, the second pressure, and the temperature applied for a time of about 10 minutes to about 40 minutes.

4. The armor panel making process of claim 2 further comprising:

said plurality of layers including an upper surface and a lower surface, said upper surface and said lower surface each elongating proportionally; and, said upper surface and said lower surface each including about 2 to about 3 parts Part A; about 0.5 to about 1.5 parts Part B; about 0.5 to about 1.5 parts Part C wherein Part A is 1,1'-methylenebis(4-isocyanatocyclohexane) and 2-n-Octyl-4-isothianzolin-3-one; wherein Part B is at least one zinc compound and n-butyl acetate; wherein Part C is a catalyst, said catalyst including one of at least one acrylic polymer, at least one residual monomer, and water.

5. A process to manufacture an armor panel fitted contiguously to curved portions of a person wearing said armor panel, said process comprising:

assembling a plurality of layers of high velocity fragment reducing material;

placing said plurality of layers upon a mold;

deforming said plurality of layers into the mold under vacuum;

heating the mold and the plurality of layers;

applying a first pressure to a portion of said plurality of layers;

applying a second pressure to another portion of said plurality of layers;

simultaneously keeping the first pressure, the second pressure, and the temperature applied for a time to said plurality of layers and the mold;

removing said plurality of layers from the mold; and, curing said plurality of layers into an armor panel.

6. The curved armor panel manufacturing process of claim 5 further comprising:

said heating the mold and the plurality of layers occurring in a temperature range about 185° F. to about 225° F.;

said applying a first pressure occurring in a range from about 0 psi to about 4300 psi;

said applying a second pressure occurring in a range from about 0 psi to about 4300 psi;

said high velocity fragment reducing material including one of ultra high molecular weight polyethylene and para-aramid;

said keeping the first pressure, the second pressure, and the temperature applied for a time of about 10 minutes to about 40 minutes;

said plurality of layers including an upper surface and a lower surface, said upper surface and said lower surface each elongating proportionally; and, said upper surface and said lower surface each including about 2 to about 3 parts Part A; about 0.5 to about 1.5 parts Part B; about 0.5 to about 1.5 parts Part C wherein Part A is 1,1'-methylenebis(4-isocyanatocyclohexane) and 2-n-Octyl-4-isothianzolin-3-one; wherein Part B is at least one zinc compound and n-butyl acetate; wherein Part C is a catalyst, said catalyst including one of at least one acrylic polymer, at least one residual monomer, and water.

* * * * *